US005784729A

United States Patent [19]

Dunn et al.

[11] Patent Number: 5,784,729

[45] Date of Patent: Jul. 28, 1998

[54] INVALID HOIST

[75] Inventors: Robert Dunn; Michael George Gill, both of Cheltenham; John Greaves, Romsey; Richard Ian Lees; Bruce Edward Somerton, both of Gloucestershire, all of England

[73] Assignee: Arjo Limited, Gloucester, England

[21] Appl. No.: 737,531

[22] PCT Filed: Mar. 20, 1995

[86] PCT No.: PCT/GB95/00606

§ 371 Date: Feb. 11, 1997

§ 102(e) Date: Feb. 11, 1997

[87] PCT Pub. No.: WO95/30400

PCT Pub. Date: Nov. 16, 1995

[30] Foreign Application Priority Data

May 10, 1994 [GB] United Kingdom ..... 9409211
Jan. 27, 1995 [GB] United Kingdom ..... 9501629

[51] Int. Cl.[6] ..... A61G 7/10

[52] U.S. Cl. ..... 5/86.1; 5/83.1

[58] Field of Search ..... 5/86.1, 83.1, 85.1, 5/87.1, 81.1 R

[56] References Cited

U.S. PATENT DOCUMENTS

| | | | |
|---|---|---|---|
| 3,203,009 | 8/1965 | Lundberg | 5/86.1 |
| 3,711,877 | 1/1973 | Averill | 5/86.1 |
| 4,682,377 | 7/1987 | Reich | 5/86.1 |
| 4,987,976 | 1/1991 | Daugherty | 187/11 |
| 5,082,127 | 1/1992 | Huang | 212/265 |
| 5,261,640 | 11/1993 | Yuan | 254/8 B |
| 5,412,820 | 5/1995 | Richards | 5/86.1 |

FOREIGN PATENT DOCUMENTS

| | | |
|---|---|---|
| 0 241 096 | 10/1987 | European Pat. Off. . |
| 0 373 392 | 6/1990 | European Pat. Off. . |
| 0 506 245 | 9/1992 | European Pat. Off. . |
| 0 581 223 | 2/1994 | European Pat. Off. . |
| 42 09 233 | 9/1993 | Germany . |
| 338272 | 6/1959 | Switzerland . |
| 234320 | 11/1994 | Taiwan . |
| 813617 | 5/1959 | United Kingdom . |
| 2 105 677 | 3/1983 | United Kingdom . |
| 2 222 814 | 3/1990 | United Kingdom . |
| 2 260 751 | 4/1993 | United Kingdom . |
| 2 281 062 | 2/1995 | United Kingdom . |

*Primary Examiner*—Alexander Grosz
*Attorney, Agent, or Firm*—Young & Thompson

[57] ABSTRACT

The invalid hoist comprises a mobile chassis 10, a lifting column 11 upstanding from the chassis and a lifting arm 12 supported by the lifting column. The chassis comprises a main portion 13 extending transversely of the hoist and two side members 14 which are movable between a first in-use position in which they project forwardly from the main portion, and a second storage position in which they extend parallel or substantially parallel to the lifting column. Side members 14 are also pivotable about a vertical axis, allowing them to spread away from one another at their forward ends. Releasable means 22 may be provided for holding the lifting arm in an operative position and for releasing the lifting arm to allow it to pivot into a storage position alongside the lifting column. Alternatively, an extendible, retractable device may be connected between the lifting arm and the lifting column at positions remote from the pivot axis between the lifting arm and the lifting column so that the lifting arm can be moved between an operative position and a storage position alongside the lifting column.

16 Claims, 5 Drawing Sheets

INVALID HOIST

BACKGROUND OF THE INVENTION

This invention relates to an invalid hoist and more particularly to an invalid hoist which is intended primarily, but not exclusively, for domestic use.

SUMMARY OF THE INVENTION

According to a first aspect of the invention there is provided an invalid hoist comprising a mobile chassis, a lifting column upstanding from the chassis and a lifting arm supported by the lifting column, wherein the chassis comprises a main portion extending transversely of the hoist and two side members which are movable between a first in use position in which they project forwardly from the main portion and a second storage position in which they extend parallel or substantially parallel to the lifting column.

Preferably, the rear ends of the side members and two wheels or castors provided on the main chassis portion support the hoist in a stable upright position when the side members are in said second storage position.

Preferably, the hoist includes four wheels or castors, two on the main chassis portion and one on each of the side members.

Preferably, the lifting arm is pivotably connected to the lifting column. In this case, releasable means may be provided for holding the lifting arm in an operative position and for releasing the lifting arm to allow it to pivot into a storage position alongside the lifting column. Alternatively, an extendible/retractable stay could be connected between the lifting arm and the lifting column at positions remote from the pivot axis between the lifting arm and the lifting column so that the lifting arm can be moved between an operative position and a storage position alongside the lifting column. In this latter case, the stay may include two threaded members which are rotatable relative to one another to extend and retract the stay.

Preferably, the lifting column is in the form of a telescopic mast having a lower part fixed to the main chassis portion and an upper part which can be raised or lowered relative to the lower part. In this case, the lifting arm is, preferably, pivotably connected to the upper part of the mast and has a first limb extending forwardly of the mast and a second limb extending rearwardly of the mast, the second limb being connected by a tie rod to the lower mast part so that as the mast is extended and retracted the lifting arm pivots upwards and downwards, respectively. In this case, the aforesaid releasable means could be provided between the tie rod and the lower mast part or the lifting arm or the tie rod could be in the form of an extendible/retractable stay as aforesaid. Also, in this case, the mast may be in the form of a telescopic actuator powered by a rechargeable battery.

Preferably, a sling hanger is supported by the free end of the lifting arm. In this case, the sling hanger is, preferably, pivotable about a horizontal axis and has two spaced sling attachment points one side of the axis and at least one sling attachment point on the other side of the horizontal axis.

Preferably, the side members are pivotably connected to the main chassis portion for movement between said first in use position and said second storage position. The side members may also be pivotable, when in said first in use position, between a position in which they extend parallel to one another and a position in which they diverge towards their forward ends.

Preferably, a handle is provided on the lifting arm for allowing an operator to move the hoist along a floor surface.

In this case, preferably, the handle extends at least part way along each of two opposite sides of the lifting arm and has a transverse portion adjacent to the rear end of the lifting arm.

According to a second aspect of the invention there is provided an invalid hoist comprising a mobile chassis, a lifting column upstanding from the chassis and a lifting arm supported by the lifting column, wherein the lifting arm is pivotably connected to the lifting column and wherein an extendible/retractable device is connected between the lifting arm and the lifting column at positions remote from the pivot axis between the lifting arm and the lifting column so that the lifting arm can be moved between an operative position and a storage position alongside the lifting column.

BRIEF DESCRIPTION OF THE DRAWINGS

The invention will now be more particularly described, by way of example, with reference to the accompanying drawings in which.

DESCRIPTION OF THE PREFERRED EMBODIMENT

Referring firstly to FIGS. 1 to 4 of the drawings, the invalid hoist shown therein comprises a mobile chassis 10, a lifting column 11 upstanding from the chassis 10 and a lifting arm 12 supported by the lifting column 11.

Figure 1:
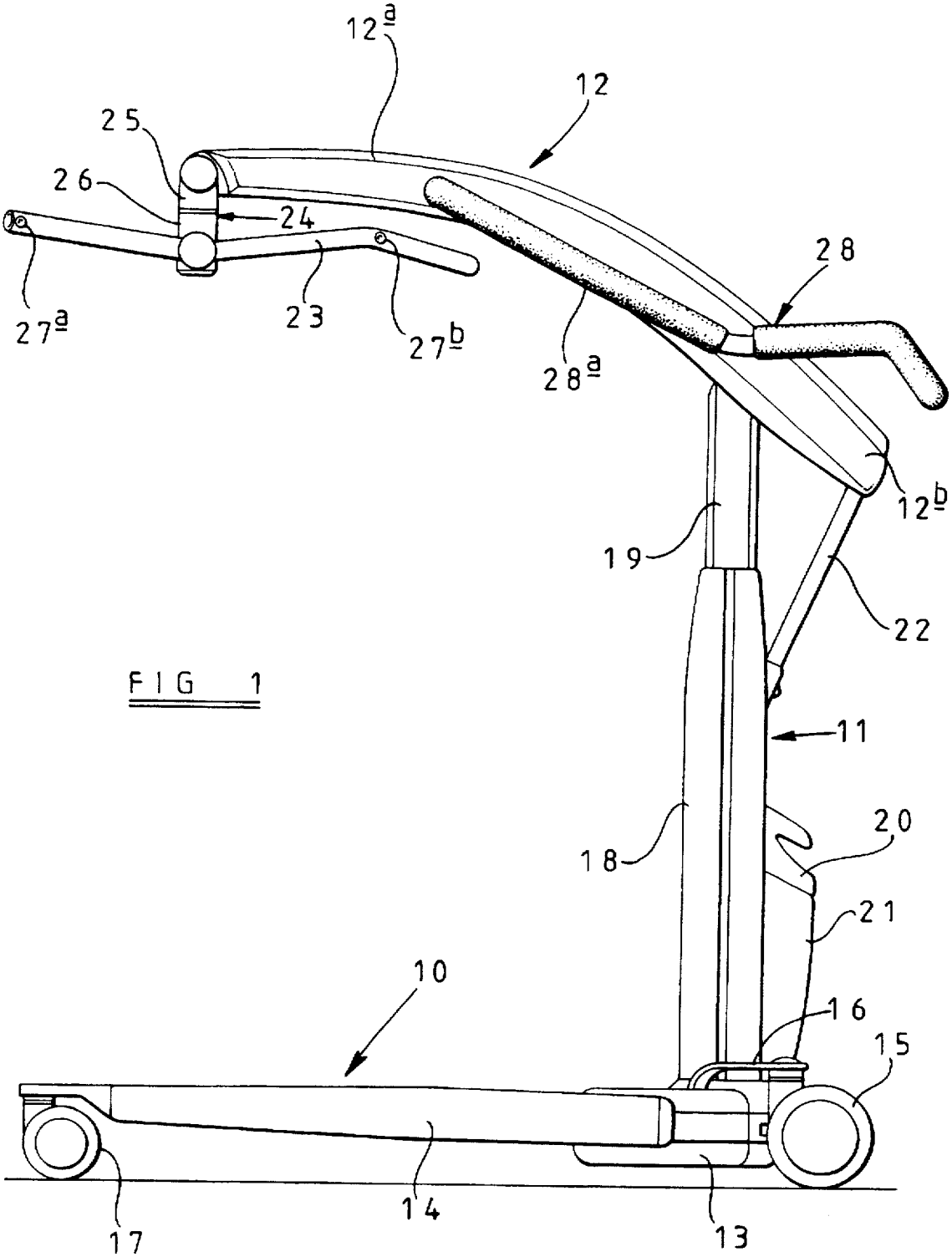
FIG. 1 is a side view of one embodiment of an invalid hoist according to the invention, the hoist being shown in an in use condition.
Figure 2:
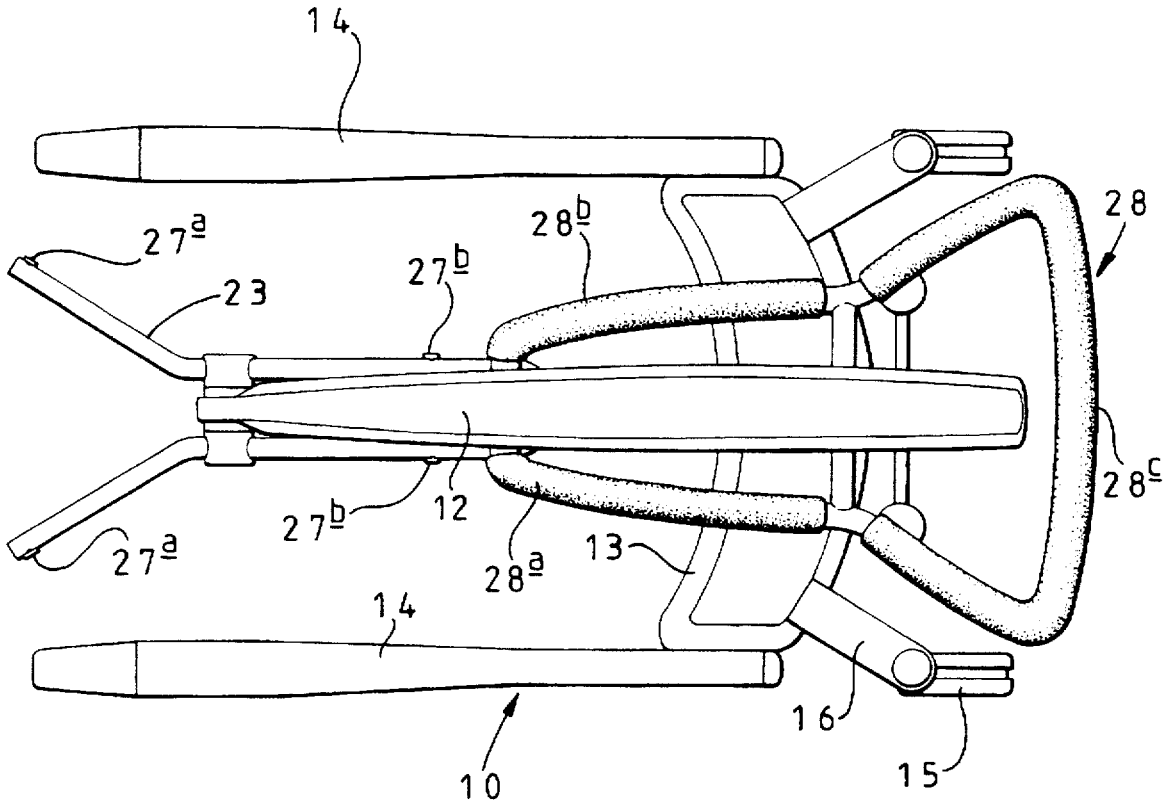
FIG. 2 is a plan view of the hoist shown in FIG. 1.
Figure 3:
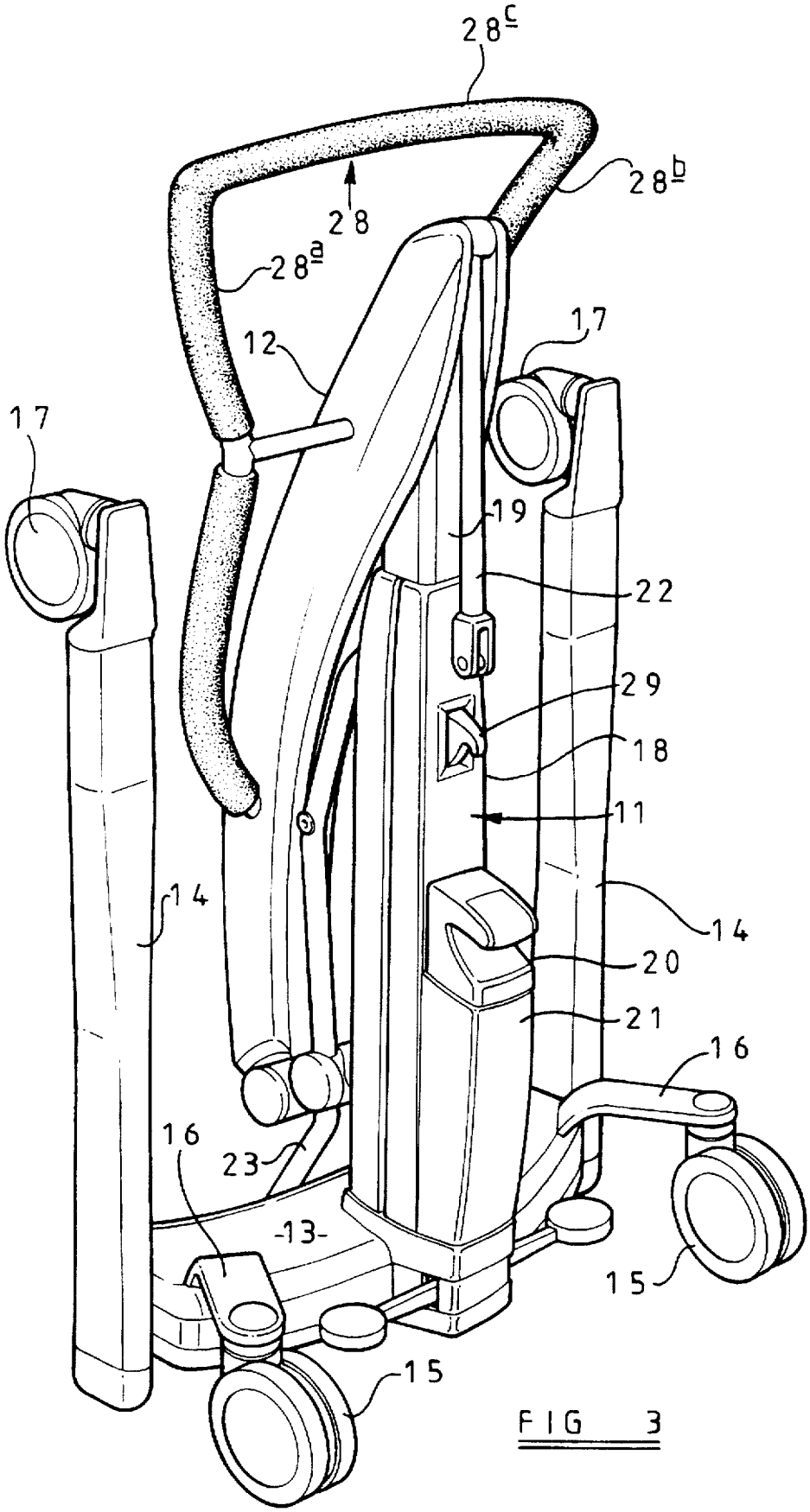
FIG. 3 is a perspective view of the hoist shown in FIGS. 1 and 2 but shown in a collapsed storage condition.
Figure 4:
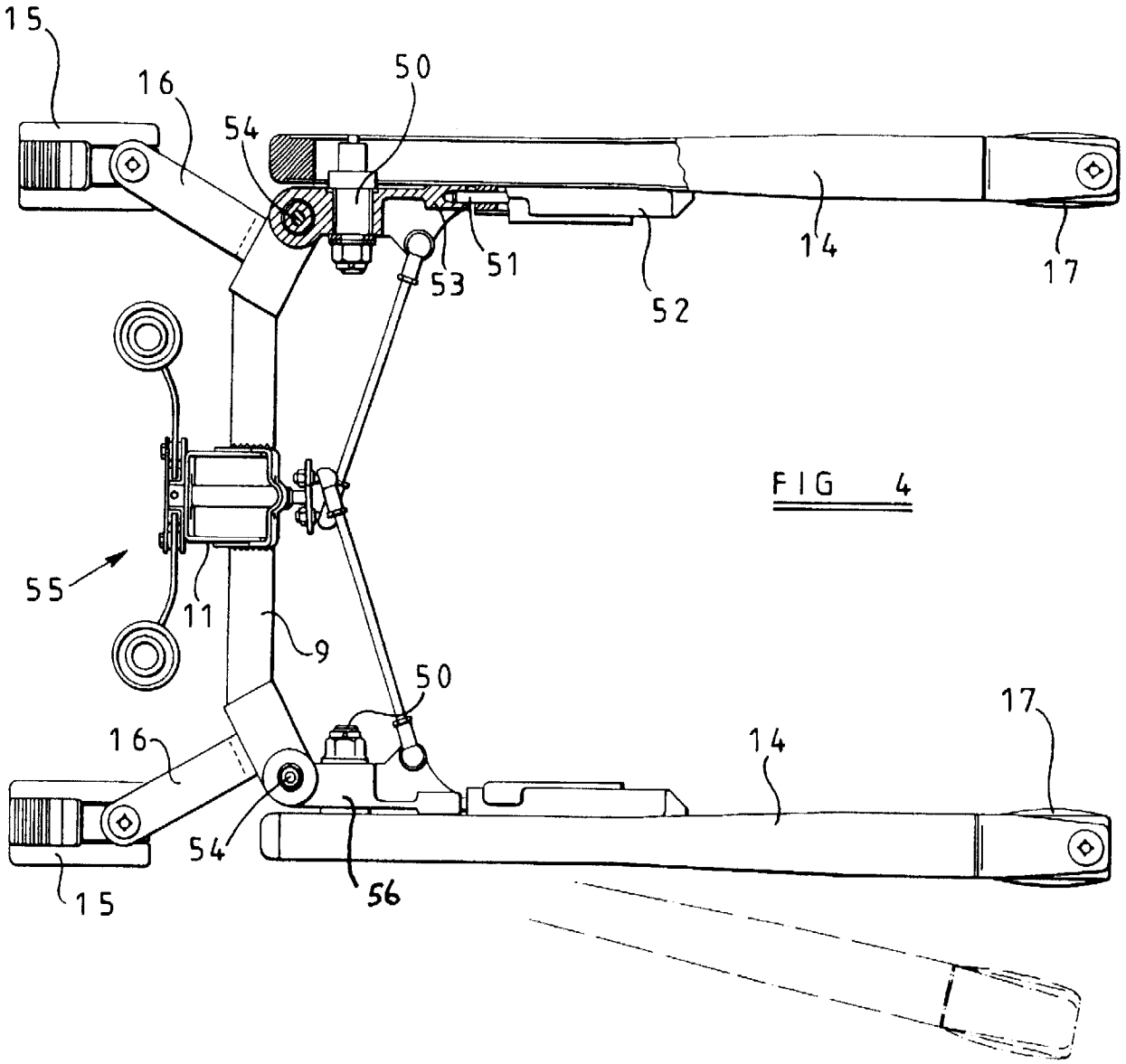
FIG. 4 is a sectional view through the mast and showing the chassis of the hoist with the cover removed.

As shown in FIG. 4, the chassis 10 comprises a main chassis portion 9 extending transversely of the hoist and two side members 14. The side members 14 are pivotable relative to the main chassis portion 9 in respective vertical planes between a first in use position (as shown in FIGS. 1,2 and 4) in which they project forwardly from the main portion 9 and a second storage position (as shown in FIG. 3) in which they extend parallel or substantially parallel to the lifting column 11 and in which they lie in a common vertical plane offset slightly from the lifting column 11. The side members 14 are also pivotable relative to the main chassis portion 9 (when in an in use position) in a common horizontal plane to increase the width of the front opening of the chassis to fit around, for example, a wheelchair. To achieve this, connecting arms 56 are provided between the main chassis portion 9 and the side members 14. The connecting arms 56 are pivotably connecting to opposite ends of the main chassis portion 9 for pivotable movement about respective vertical axes 54 and the side members 14 are pivotably connected to respective connecting arms 56 for pivotable movement relative thereto about respective horizontal axes 50. A mechanism 55 is provided for pivoting the connecting arms 56 relative to the main chassis portion 9 so as to open and close the side members 14 and releasable fastening means are provided between the side members 14 and respective connecting arms 56 to retain the side members in an in use position. The releasable fastening means may take the form of bolts 51 slidably mounted in holders 52 mounted on the side members 14 and sockets 53 supported by the connecting arms 56.

The main chassis portion 9 and the connecting arms 56 are enclosed in a cover 13 to improve the aesthetic appearance of the hoist.

The main chassis portion 9 is provided with two wheels or castors 15 supported by brackets 16 and each side member 14 is provided with a single wheel or castor 17 provided at or adjacent to its front end.

The side members 14 each project rearwardly of the axis 50 about which they are pivotably connected to the connecting arms 56 (as considered in an in use position) to such an extent that when they are in the second storage position the rear ends of the side members 14 and the two wheels or castors 15 provided on the main chassis portion 13 together support the hoist in a stable upright position (as shown in FIG. 3).

The lifting column 11 is in the form of a telescopic actuator which itself forms a mast having a lower part 18 which is secured to the main chassis portion 9 and an upper part 19. The telescopic actuator 11 is powered by a rechargeable battery 20 mounted in a compartment 21 at the rear of the actuator.

The lifting arm 12 is pivotably connected to the upper end of the upper actuator part 19 and has a first limb **12*a* extending forwardly of the actuator and a second relatively shorter limb 12*b* extending rearwardly of the actuator. The rear end of the limb 12*b* is connected by a tie rod 22 to the lower actuator part 18 so that when the actuator 11 is extended, the lifting arm 12 will pivot upwards and, when the actuator is retracted, the lifting arm 12** will pivot downwards.

The tie rod 22 is pivotably connected to the rear end of the limb **12*b* of the lifting arm and is pivotably connected to the lower actuator part 18 by releasable fastening means 29 so that the lifting arm 12 can be released to allow it to pivot into a storage position alongside the mast 11 (as shown in FIG. 3**).

A sling hanger 23 is connected to the front end of the lifting arm 12 by a sling hanger support 24. The support 24 comprises two parts 25 and 26 rotatable relative to one another about a vertical or substantially vertical axis. The part 25 is pivotably connected to the lifting arm about a first horizontal axis and the sling hanger 23 is pivotably connected to the second part 26 about a second horizontal axis.

The sling hanger 23 has two widely spaced sling attachment points **27*a* on one side of the second horizontal axis and two more closely spaced sling attachment points 27*b* on the other side of the second horizontal axis. A single body support sling can then be attached to the sling attachment points 27*a*, 27*b* to support a patient. The two sling attachment points 27*b*** could be replaced by a single attachment point.

A handle 28 is provided on the lifting arm to allow an operator to move the hoist along a floor surface. The handle 28 has two side limbs **28*a* and 28*b* which extend along each of two opposite sides of the lifting arm 12 and a transverse portion 28*c* adjacent to the rear end of the lifting arm 12**. This allows the operator to maneuver the hoist from either side or from the rear of the hoist.

Figure 5:
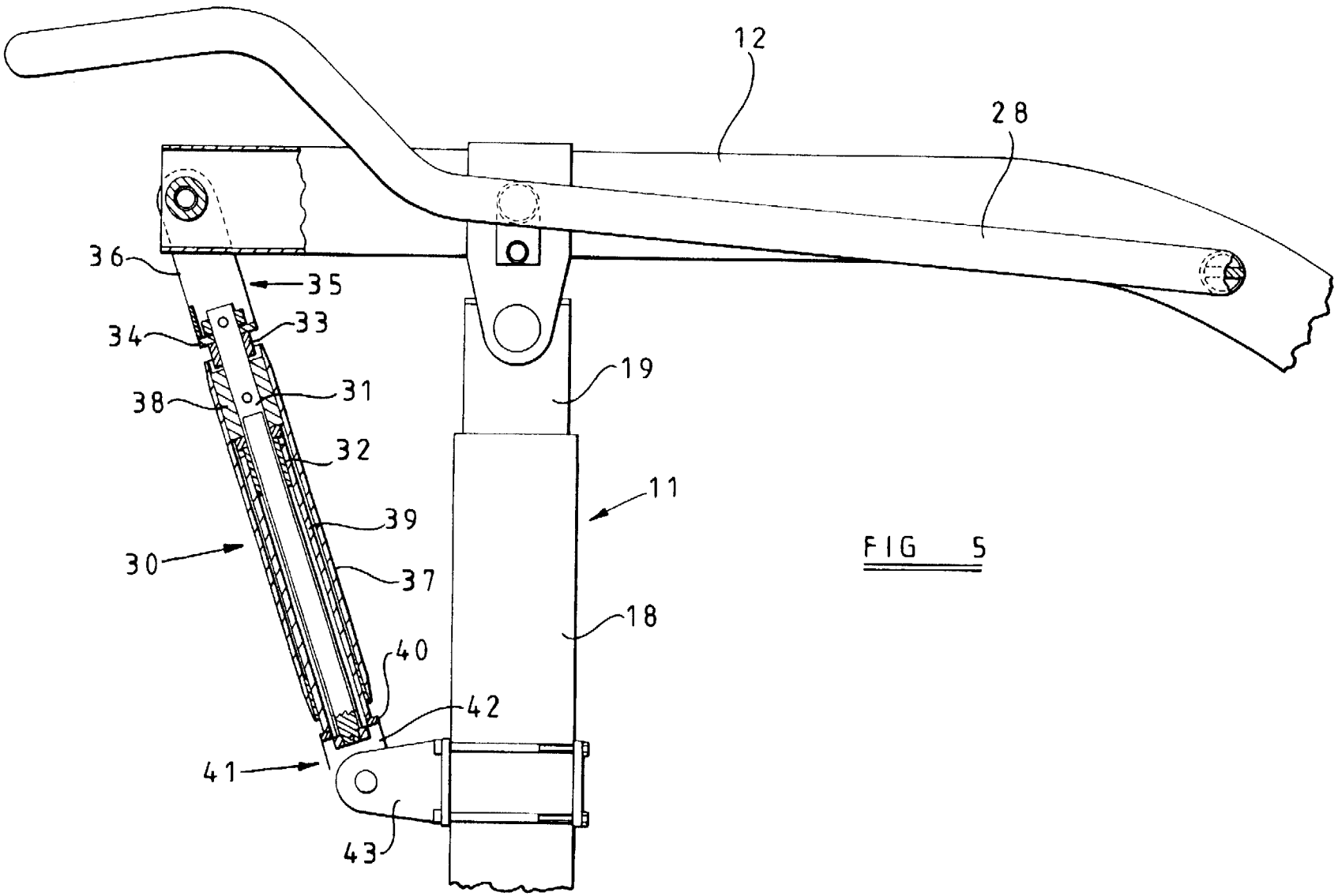
FIG. 5 is a fragmentary side view, partly in section, showing a modification to the hoist shown in FIG. 1.

FIG. 5 shows a modification to the embodiment described above. In this case, the tie rod 22 is in the form of an extendible/retractable stay 30 which comprises an externally threaded spindle 31 and an internally threaded nut 32. The spindle 31 is mounted for rotation in a bush 33 welded to the web 34 of a U-shaped bracket 35 which is pivotably connected adjacent to the free ends of its two arms 36 to the rear end of the lifting arm 12. A sleeve 37 is connected to the spindle 31 by a collar 38 so that the sleeve 37 surrounds the spindle 31 and an annular space is provided between the spindle 31 and the sleeve 37.

The nut 32 is secured to a further sleeve 39 which is secured to the web 40 of a further U-shaped bracket 41 pivotably connected adjacent to the free ends of its two arms 42 to a lug 43 clamped to the lower actuator part 18. The nut 32 and further sleeve 39 are located in the annular space between the spindle 31 and the sleeve 37 and the nut 32 co-operates with the spindle 31.

The spindle 31 can be rotated relative to the nut 32 to extend or retract the stay 30 by rotating the sleeve 38. This will allow the lifting arm 12 to be moved between its operative position (shown in FIGS. 1 & 2) and its storage position (shown in FIG. 3) alongside the mast.

This arrangement has the advantage over the use of the releasable tie bar 22 in that it provides controlled movement of the lifting arm 12 and thus prevents rapid movement of the lifting arm 12 to its storage position with the associated risk of harming an operator.

The above embodiment are given by way of example only and various modifications will be apparent to persons skilled in the art without departing from the scope of the invention. For example, the tie rod 22 could be releasably connected to the lifting arm 12 instead of being releasably connected to the lower actuator part 18. Also, the actuator could be provided within an outer telescopic housing instead of defining the mast by itself.

We claim:

1. An invalid hoist comprising a mobile chassis (10), a lifting column (11) upstanding from the chassis and a lifting arm (12) supported by the lifting column, wherein the chassis comprises a transversely extending portion (13) from which the lifting column upstands and two side members (14) which are pivotable between a first in use position in which they project forwardly from the transversely extending portion and a second storage position in which they extend parallel or substantially parallel to the lifting column and which are also pivotable between a position in which they extend parallel or substantially parallel to one another and a position in which they diverge towards their forward ends.

2. An invalid hoist as claimed in claim 1, wherein the rear ends of the side members (14) and two wheels or castors (15) provided on the transversely extending chassis portion (13) support the hoist in a stable upright position when the side members (14) are in said second storage position.

3. An invalid hoist as claimed in claim 1, wherein the hoist includes four wheels or castors, two (15) on the transversely extending chassis portion (13) and one (17) on each of the side members (14).

4. An invalid hoist as claimed in claim 1, wherein the lifting arm (12) is pivotably connected to the lifting column (11).

5. An invalid hoist as claimed in claim 4, wherein releasable means (22) are provided for holding the lifting arm (12) in an operative position and for releasing the lifting arm to allow it to pivot into a storage position alongside the lifting column (11).

6. An invalid hoist as claimed in claim 4, wherein an extendable/retractable stay (30) is connected between the lifting arm (12) and the lifting column (11) at positions remote from the pivot axis between the lifting arm and the lifting column so that the lifting arm can be moved between an operative position and a storage position alongside the lifting column.

7. An invalid hoist as claimed in claim 6, wherein the stay (30) includes two threaded members (31,32) which are rotatable relative to one another to extend and retract the stay.

8. An invalid hoist as claimed in claim 1, wherein the lifting column (11) is in the form of a telescopic mast having a lower part (18) fixed to the transversely extending chassis portion and an upper part (19) which can be raised or lowered relative to the lower part.

9. An invalid hoist as claimed in claim 8, wherein the lifting arm (12) is pivotably connected to the upper part (19) of the mast and has a first limb (12*a*) extending forwardly at the mast and a second limb (12*b*) extending rearwardly of the mast, the second limb being connected by a tie rod (22,30) to the lower mast part so that as the mast is extended and retracted the lifting arm pivots upwards and downwards, respectively.

10. An invalid hoist as claimed in claim 9 further comprising a releasable means provided for holding the lifting arm (12) in an operative position and for releasing the lifting arm to allow it to pivot into a storage position alongside the lifting column (11), wherein the releasable means is provided between the tie rod and the lower mast part or the lifting arm.

11. An invalid hoist as claimed in claim 9 further comprising an extendable/retractable stay (30) connected between the lifting arm (12) and the lifting column (11) at positions remote from the pivot axis between the lifting arm and the lifting column so that the lifting arm can be moved between an operative position and a storage position alongside the lifting column, wherein the tie rod is formed by said extendable/retractable stay (30).

12. An invalid hoist as claimed in claim 8, wherein the mast is in the form of a telescopic actuator powered by a rechargeable battery (20).

13. An invalid hoist as claimed in claim 1, wherein a sling hanger (23) is supported by the free end of the lifting arm.

14. An invalid hoist as claimed in claim 13, wherein the sling hanger (23) is pivotable about a horizontal axis and has two spaced sling attachment points (27*a*) on one side of the axis and at least one sling attachment point (27*b*) on the other side of the axis.

15. An invalid hoist as claimed in claim 1, wherein a handle (28) is provided on the lifting arm for allowing an operator to move the hoist along a floor surface.

16. An invalid hoist as claimed in claim 15, wherein the handle (28) extends at least part way along each of two opposite sides of the lifting arm and has a transverse portion adjacent (28*c*) to the rear end of the lifting arm.

* * * * *